US007214087B2

(12) United States Patent
Kuo

(10) Patent No.: US 7,214,087 B2
(45) Date of Patent: May 8, 2007

(54) CABLE CONNECTOR HAVING FASTENING MEMBER

(75) Inventor: Peter Kuo, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/527,284

(22) Filed: Sep. 26, 2006

(65) Prior Publication Data

US 2007/0082536 A1 Apr. 12, 2007

(30) Foreign Application Priority Data

Sep. 28, 2005 (CN) ..... 2005 2 0076109

(51) Int. Cl.
*H01R 13/627* (2006.01)

(52) U.S. Cl. ..... 439/364

(58) Field of Classification Search ..... 439/362, 439/364, 363, 953

See application file for complete search history.

(56) References Cited

U.S. PATENT DOCUMENTS 3,487,353 A * 12/1969 Massa ..... 439/281
6,522,532 B2 * 2/2003 Liao et al. ..... 361/686
6,908,344 B1 6/2005 Ahmed
2003/0045154 A1 * 3/2003 Ayers et al. ..... 439/362

* cited by examiner

*Primary Examiner*—Phuong Dinh
(74) *Attorney, Agent, or Firm*—Wei Te Chung

(57) ABSTRACT

A cable connector (100) in accordance with the present invention includes an insulative housing (1) defining a number of passageways (13) therethrough, a number of contacts (2) assembled to the insulative housing and respectively received in the passageways, a cable (5) including a number of conductors (50) respectively electrically connecting with connecting portions of the contacts to form a number of junctions, a cover (6) enclosing the rear end of the housing (1) and junctions between the contacts (2) and the cable (5), the cover (6) having a mating face (620) having at least a longer edge (622) and a projection (621) formed on outer periphery of the cover (6) with front surface coplanar with the mating face of the cover the projection and defining a fastening hole (6210) therethrough; and a fastening member (7) inserted into the cover and coupling with the fastening hole (6210) for fastening the cable connector (100) to a coupling device.

5 Claims, 5 Drawing Sheets

CABLE CONNECTOR HAVING FASTENING MEMBER

BACKGROUND OF THE INVENTION

1. Field of the Invention

The present invention generally relates to a cable connector, and more particularly to a cable connector having fastening member.

2. Description of Related Art

To satisfy current particular commands in market, in April 2002, Hitachi, Panasonic, Phillips, Sony, Thomason, Toshiba and Silicon Image et al. found High-definition Digital Multimedia Interface (HDMI) Association to develop new standard for high-definition video and channel audio. An HDMI cable assembly comprises an insulative housing, a plurality of contacts assembled to the insulative housing, a conductive shell surrounding the insulative housing, and a cable electrically connecting with the contacts. Referring to FIG. 5, a conventional HDMI cable assembly has a mating portion 101. When the cable assembly mates with a mating connector, the mechanism connection of the cable assembly and the mating connector only depends on the friction produced between the contacts of each other and/or between the mating portion 101 and the mating connector body. However, when such type HDMI cable assembly is usually used out of a chassis, after the HDMI cable assembly has been used for a long time, or when inaccidental pulling force is exerted to the cable, it often leads to the HDMI cable assembly apart from the mating connector, thus influenting the normal signal transmission.

Therefore, designers usually utilize a pair of fastening members, such as screws, disposed at lateral portions of the connector to enhance the mechanism and electric connection between the two mating connectors. However, this manner certainly increases the transverse size of the connector. With the increase of the numbers of different connector interfaces arranged on the mounting board, the distribution of connector correspondingly become more and more densely, establishing screws at lateral portions is not benefit for connectors' distribution.

Therefore, it is desirable to provide a cable connector, which eliminates the aforesaid drawbacks.

BRIEF SUMMARY OF THE INVENTION

Accordingly, an object of the present invention is to provide a cable connector with improved fastening member and having reduced size.

In order to achieve the above-mentioned object, A cable connector, comprising an insulative housing defining a plurality of passageways therethrough, a plurality of contacts assembled to the insulative housing and respectively received in the passageways, a cable comprising a plurality of conductors respectively electrically connecting with the contacts to form a plurality of junctions, a cover enclosing the rear end of the housing and junctions between the contacts and the cable, the cover having a mating face having at least a longer edge and a projection formed on outer periphery of the cover with front surface coplanar with the mating face of the cover the projection defining a fastening hole therethrough, and a fastening member fixed to the cover coupling with the fastening hole for fastening the cable connector to a coupling device.

Other objects, advantages and novel features of the invention will become more apparent from the following detailed description of the present embodiment when taken in conjunction with the accompanying drawings.

DETAILED DESCRIPTION OF THE INVENTION

Figure 1:
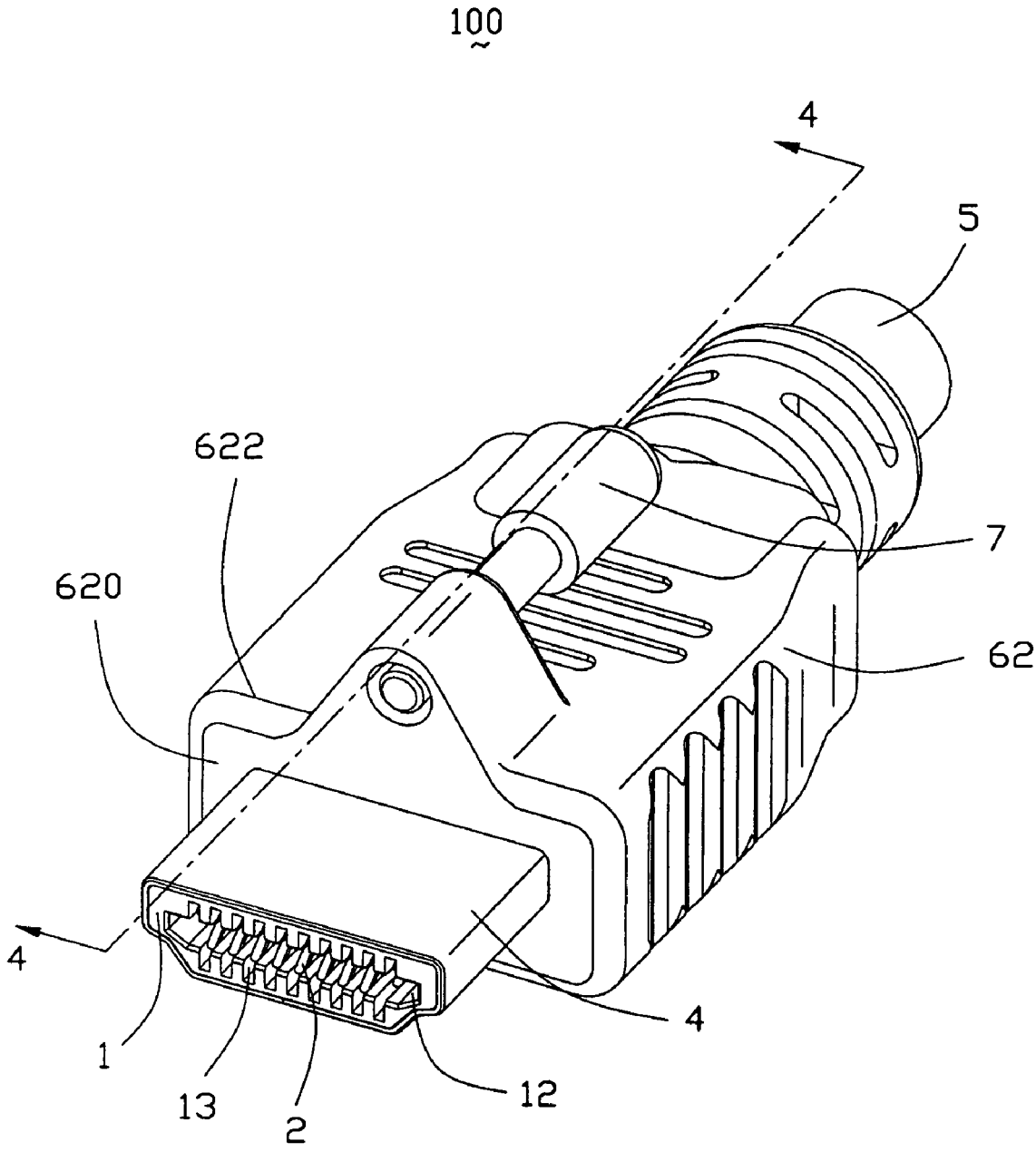
FIG. 1 is an assembled, perspective view of a cable connector in accordance with the present invention.
Figure 2:
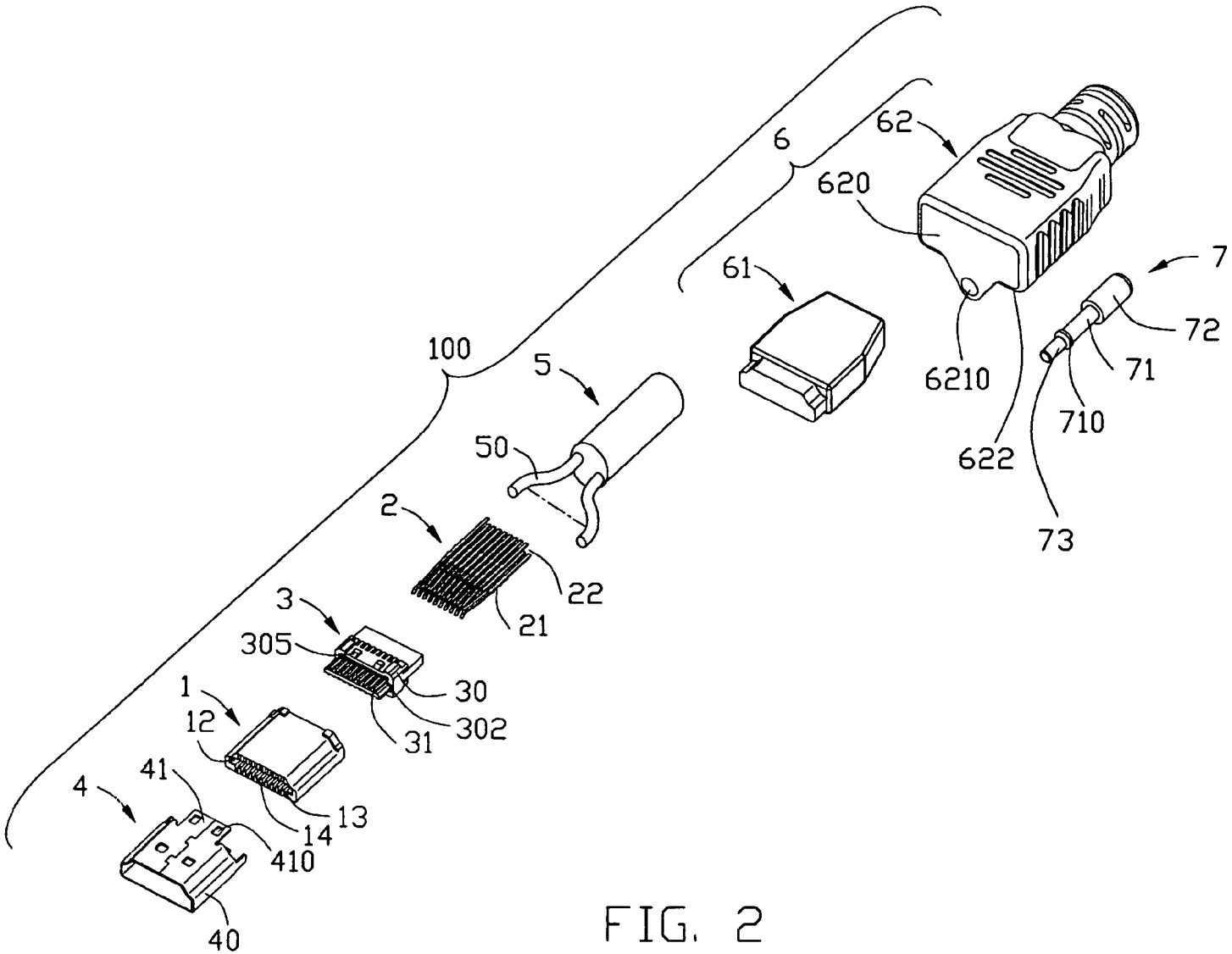
FIG. 2 is an exploded, perspective view of FIG. 1.
Figure 3:
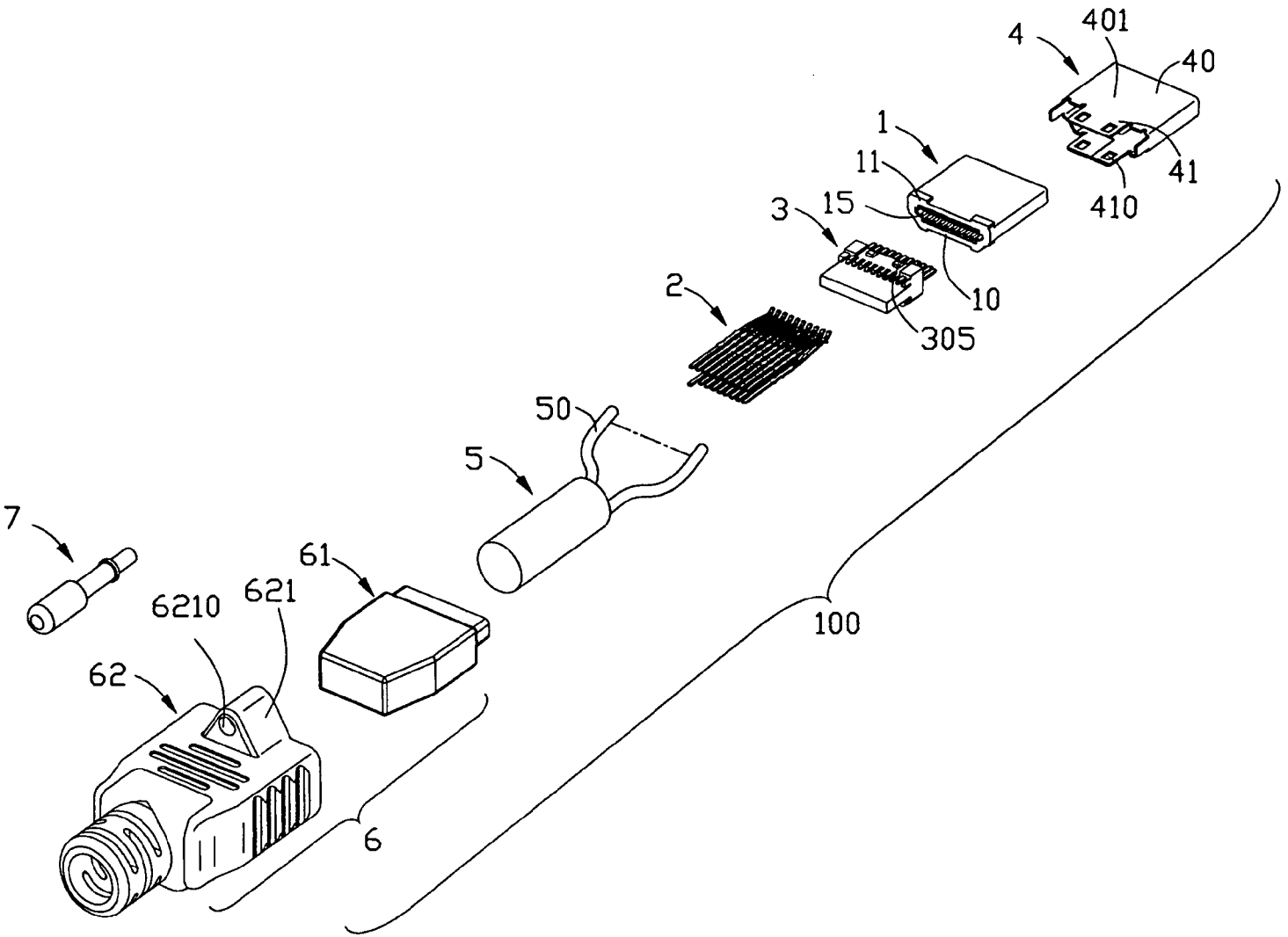
FIG. 3 is a view similar to FIG. 2, but viewed from a different aspect.

Reference will now be made to the drawing figures to describe the present invention in detail.

Referring to FIGS. 1–4, a cable connector 100 in accordance with the present invention is according to HDMI (High-Definition Digital Multimedia Interface) standard and comprises an insulative housing 1, a plurality of contacts 2 assembled to the insulative housing 1, a spacer 3 sealing the rear end of the insulative housing 1, a conductive shell 4 shielding the insulative housing 1, a cable 5 electrically connecting with the contacts 2, a cover 6 comprising an inner mold 61 and an outer mold 62, and a fastening member 7 assembled to a fastening hole 6210 located on the cover 6.

The insulative housing 1 defines a front portion 14 mating with a complementary connector and a rear portion 15 coupling with the shell 4 and the spacer 3. The insulative housing 1 comprises an upper wall 10, a lower wall 11 and a receiving space 12 formed therebetween. The upper wall 10 parallels the lower wall 11 with shorter length. The upper wall 10 and the lower wall 11 both define a plurality of passageways 13 on inner surfaces thereof communicating with the receiving space 12 from the front portion 14 to the rear portion 15 for receiving the contacts 2. In addition, the number of the passageways 13 of the upper wall 10 is not equal to that of the passageways 13 of the lower wall 11.

The spacer 3 forms a plurality of grooves 302 therethrough corresponding to the passageways 13 of the insulative housing 1. The contacts 2 respectively protrude through the grooves 302 with mating portions 21 received in the passageways 13, connecting portions 22 electrically connecting with conductors 50 of the cable 5, preferably soldering in the embodiment. The rear end 30 of the spacer 3 forms two pairs of protrusions 305 respectively on upper and lower surfaces thereof. The spacer 3 is assembled to the insulative housing 1 from rear-to-back direction and seals the rear portion of the insulative housing 1; the front end 31 of the spacer 3 is received in the rear of the receiving space 12.

Referring to FIGS. 1–4, the conductive shell 4 is stamped from a metal sheet and then bent to form the current shape. The conductive shell 4 comprises a body portion 40 enclosing the insulative housing 1 and a pair of stretching portions 41 extending rearwardly from the body portion 40. Corresponding to the protrusions 305 of the spacer 3, each stretching portion 40 forms a pair of rectangular engaging holes 410 serving as blocking means. The conductive shell 4 encloses the outer periphery of the insulative housing 1 and the engaging holes 410 thereof latchably engage with the protrusions 305 of the spacer 3 assembled to the insulative housing 1. Via the above engagement, the conductive shell 4 and the spacer 3 both assembled to the insulative housing 1 are reliably assembled to each other.

The outer mold 62 has a mating face 620 including a pair of longer edges 622 and a triangle projection 621 extending from outer periphery of the outer mold 62 with front surface thereof locating adjacent to the mating face 620 or coplanar with the mating face 620. The projection 621 is formed with the longer edge 622. When the cable connector 100 is assembled to a panel of a chassis, the mating face 620 will be close to the panel, and so does the projection 621. The projection 621 defines the cylindrical fastening hole 6210 therethrough and a step (not labeled) is formed in inner periphery of the fastening hole 6210 and located near the rear end of the projection 621, thus, since the diameter of the rear portion of the fastening hole 6210 is smaller than that of the front portion of the fastening hole 6210. Additionally, the wider front portion of the fastening hole 6210 is longer than the narrower rear portion.

The fastening member 7 in the preferred embodiment is a screw and comprises an rear operating portion 72, a front screw portion 73 having screw threads thereof, and a base portion 71 connecting the operating portion 72 with the screw portion 73. A flange 710 protrudes outwardly from the end of the base portion 71 and adjoins the screw portion 73 to couple with the step formed in the fastening hole 6210 in the outer mold 62. The diameter of the base portion 71 is slightly smaller than that of the rear portion of the fastening hole 6210; and the diameter of the block 710 is slightly smaller than that of the front portion of the fastening hole 6210. Nevertheless, both the diameters of the flange 710 and the operation portion 72 are larger than that of the rear portion of the fastening hole 6210. Thus, when the fastening member 7 is inserted into the fastening hole 6210 from rear to front direction, the fastening member 7 is capable of sliding rearward or frontward relative to the fastening hole 6210 and has no possibility of divorcing from the fastening hole 6210. The screw portion 73 can project outward from the mating face 620 of the outer mold 62 to fasten the cable connector 100 to the coupling device reliably.

Figure 4:
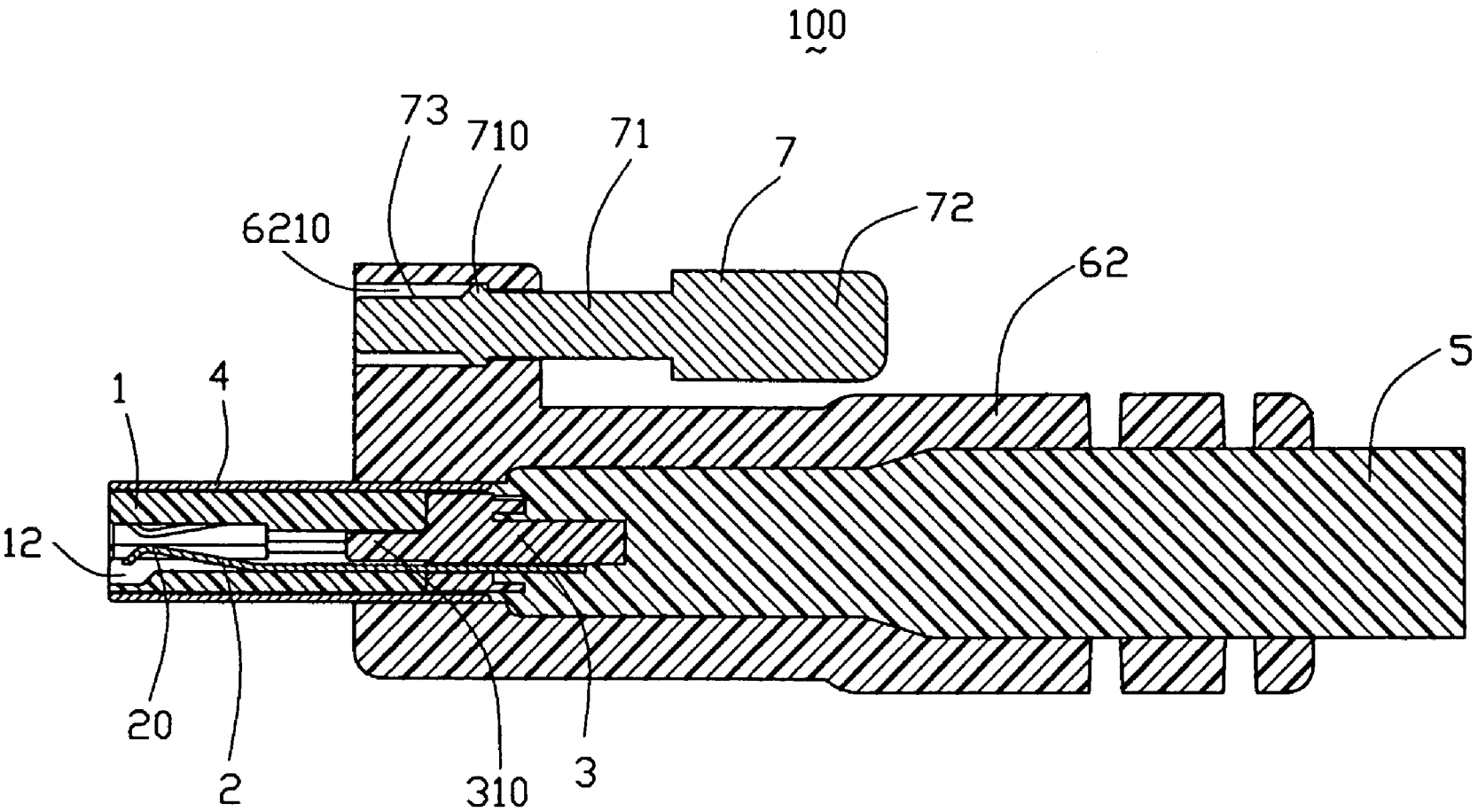
FIG. 4 is a cross-section view taken from line 4—4 of FIG. 1.
Figure 5:
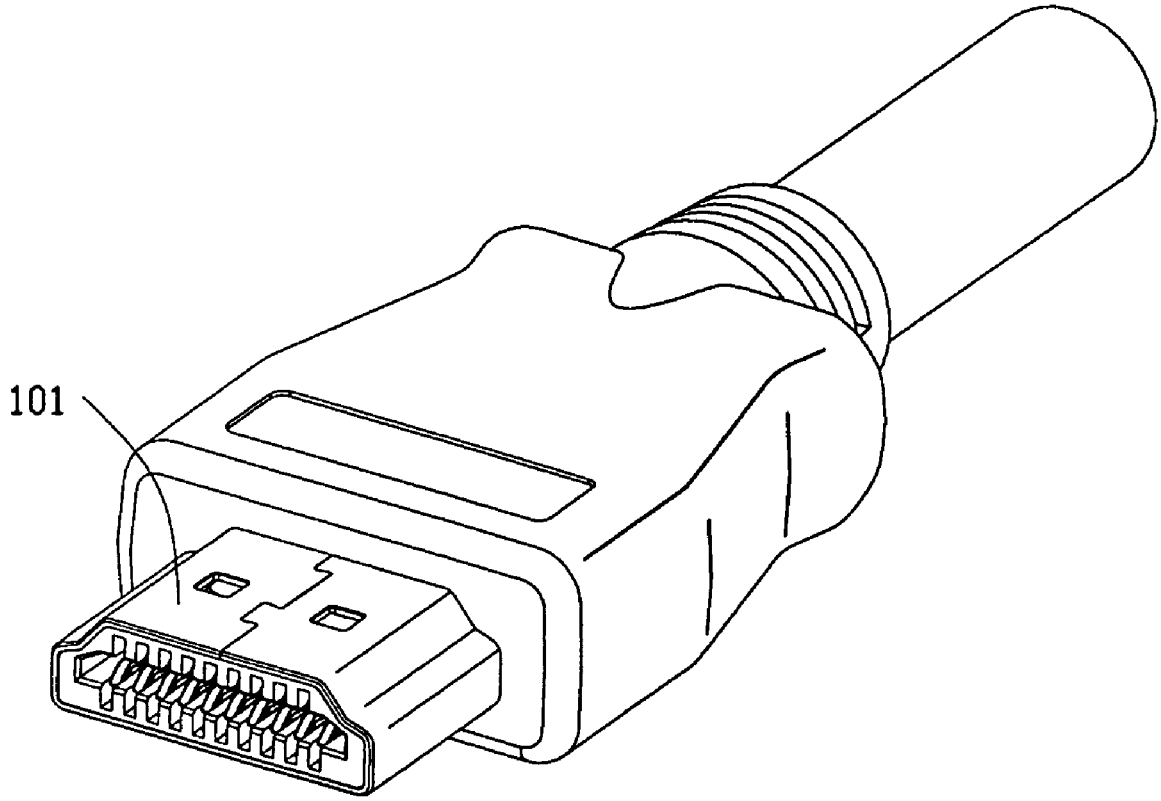
FIG. 5 is a perspective view of a conventional cable connector.

Please refer to FIG. 4, after the assembly of the insulative housing 1, the contacts 2, the spacer 3, the conductive shell 4 and the cable 5, the inner mold 61 is formed by overmolding method and molded with the rear portion of the insulative housing 1, the stretching portions 41 of the conductive shell 4, the rear end 30 of the spacer 3 and the junctions of the contacts 2 and the cable 5. Then, the outer mold 62 is assembled or overmolded to the above assembly, and thus, encloses the rear end of the conductive shell 4 and the inner mold 61. Finally, the fastening member 7 is inserted into the fastening hole 6210 from rear to front direction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable connector, comprising:

an insulative housing defining a plurality of passageways therethrough;

a plurality of contacts assembled to the insulative housing and respectively received in the passageways;

a cable comprising a plurality of conductors respectively electrically connecting with the contacts to form a plurality of junctions;

a cover enclosing the rear end of the housing and junctions between the contacts and the cable, the cover having a mating face having at least a long edge, a short edge and a projection formed on an outer periphery of the cover and along the long edge with a front surface coplanar with the mating face of the cover and defining a fastening hole therethrough; and a fastening member fixed to the cover and coupling with the fastening hole for fastening the cable connector to a coupling device wherein the cover further comprises a step formed in the inner periphery of the fastening hole, the diameter of the rear portion of the fastening hole is different from that of the front portion of the fastening hole, and the length of the wider portion of the fastening hole is different from that of the narrower portion, wherein the fastening member comprises an operating portion, a fastening portion, and a flange protruding outwardly from the end of the base portion and adjoining the fastening portion to couple with the step in the fastening hole in the cover, wherein the cover of the cable connector comprises an inner mold enclosing the junctions of the contacts and the conductors of the cable and an outer mold enclosing the inner mold and the cable wherein the projection is formed on the out periphery of the outer mold, a conductive shell enclosing the insulative housing, and wherein the rear portion of the conductive shell is enclosed by the inner mold, wherein the cable connector further comprises a spacer sealing the rear portion of the insulative housing, wherein the spacer has at least a protrusion on upper and lower surfaces and wherein the conductive shell defines an engaging hole coupling with the projection, wherein the cable connector is in accordance with HDMI (High-Definition Digital Multimedia Interface) standard, wherein the insulative housing comprises an upper wall, a lower wall and a receiving space formed therebetween, the upper wall parallels the lower wall and is shorter than the lower wall, wherein the passageways are formed in the inner surfaces of the upper wall and lower wall; and wherein the numbers of the passageways on the upper wall and lower wall are not equal to each other.

2. A cable connector assembly comprising:

an insulative housing defining a mating port in a front portion thereof and defining a mating direction along a front-to-back direction;

a plurality of contacts disposed in the housing and exposed to the mating port;

a cable having a plurality of conductors electrically connected to the corresponding contacts, respectively;

an insulative cover integrally molded over a rear portion of the housing and a front portion of the cable; and said cover defines a protrusion with a locking screw attached thereto and back and forth moveable along said front-to-back direction; wherein said mating port defines a long side and a short side, and the locking screw is located on the long side and accessibly operable from two sides of said locking screw along said long side wherein the cover further comprises a step formed in the inner periphery of the fastening hole, the diameter of the rear portion of the fastening hole is different from that of the front portion of the fastening hole, and the length of the wider portion of the fastening hole is different from that of the narrower portion, wherein the fastening member comprises an operating portion, a fastening portion, and a flange protruding outwardly from the end of the base portion and adjoining the fastening portion to couple with the step in the fastening hole in the cover, wherein the cover of the cable connector comprises an inner mold enclosing the junctions of the contacts and the conductors of the cable and an outer mold enclosing the inner mold and the cable wherein the projection is formed on the out periphery of the outer mold, a conductive shell enclosing the insulative housing, and wherein the rear portion of the conductive shell is enclosed by the inner mold, wherein the cable connector further comprises a spacer sealing the rear portion of the insulative housing, wherein the spacer has at least a protrusion on upper and lower surfaces and wherein the conductive shell defines an engaging hole coupling with the projection, wherein the cable connector is in accordance with HDMI (High-Definition Digital Multimedia Interface) standard, wherein the insulative housing comprises an upper wall, a lower wall and a receiving space formed therebetween, the upper wall parallels the lower wall and shorter than the lower wall, wherein the passageways are formed in the inner surfaces of the upper wall and lower wall; and wherein the numbers of the passageways on the upper wall and lower wall are not equal to each other.

3. The connector assembly as claimed in claim 2, wherein said cover and said housing are made from different materials.

4. The connector assembly as claimed in claim 2, wherein a surface of said cover, which the locking screw is located on, is raised for protecting a tail of the locking screw.

5. The connector assembly as claimed in claim 2, wherein said protrusion defines a peak configuration and the locking screw is close to said peak.

* * * * *